US009134665B2

(12) United States Patent
Park et al.

(10) Patent No.: US 9,134,665 B2
(45) Date of Patent: Sep. 15, 2015

(54) FIXING UNIT AND IMAGE FORMING APPARATUS INCLUDING THE SAME

(71) Applicant: Samsung Electronics Co., Ltd., Suwon-si, Gyeonggi-do (KR)

(72) Inventors: Sung-jun Park, Hwaseong-si (KR); Heung-sup Park, Suwon-si (KR); Yong-nam Ham, Ansan-si (KR)

(73) Assignee: SAMSUNG ELECTRONICS CO., LTD. (KR)

( * ) Notice: Subject to any disclaimer, the term of this patent is extended or adjusted under 35 U.S.C. 154(b) by 0 days.

(21) Appl. No.: 14/139,289

(22) Filed: Dec. 23, 2013

(65) Prior Publication Data

US 2014/0193171 A1 Jul. 10, 2014

(30) Foreign Application Priority Data

Jan. 7, 2013 (KR) ..... 10-2013-0001791

(51) Int. Cl.
*G03G 21/00* (2006.01)
*G03G 21/20* (2006.01)
*G03G 15/20* (2006.01)

(52) U.S. Cl.
CPC ..... *G03G 15/2064* (2013.01); *G03G 15/2017* (2013.01); *G03G 21/206* (2013.01); *G03G 2221/1645* (2013.01); *G03G 2221/1648* (2013.01)

(58) Field of Classification Search
CPC ..... G03G 2221/1648; G03G 2221/1645; G03G 21/206
USPC ..... 399/93, 98, 99
See application file for complete search history.

(56) References Cited

U.S. PATENT DOCUMENTS

| | | | | |
|---|---|---|---|---|
| 5,761,577 | A * | 6/1998 | Walsh et al. | 399/99 |
| 6,771,916 | B2 | 8/2004 | Hoffman et al. | |
| 2007/0065188 | A1* | 3/2007 | Takagaki et al. | 399/307 |
| 2009/0074480 | A1* | 3/2009 | Suzuki | 399/308 |
| 2011/0142483 | A1 | 6/2011 | Oomoto et al. | |
| 2011/0206388 | A1* | 8/2011 | Sasaoka | 399/21 |
| 2011/0243598 | A1* | 10/2011 | Suzuki | 399/98 |
| 2011/0274458 | A1* | 11/2011 | Hijikata et al. | 399/98 |
| 2012/0003021 | A1 | 1/2012 | Brown et al. | |
| 2012/0107011 | A1* | 5/2012 | Brown et al. | 399/98 |
| 2012/0141173 | A1* | 6/2012 | Iwasaki | 399/327 |
| 2014/0178091 | A1* | 6/2014 | Sugiyama et al. | 399/92 |

FOREIGN PATENT DOCUMENTS

| | | | |
|---|---|---|---|
| JP | 2011128279 | B2 | 6/2011 |
| KR | 1020050108058 | A | 11/2005 |
| KR | 1020110019179 | A | 2/2011 |

* cited by examiner

*Primary Examiner* — David Gray
*Assistant Examiner* — Tyler Hardman
(74) *Attorney, Agent, or Firm* — Cantor Colburn LLP

(57) ABSTRACT

A fixing unit includes: a fixing member which defines a fixing nip, where the fixing member fixes a toner image transferred onto a recording medium by applying heat and pressure to the toner image on the recording medium, and the recording medium passes through the fixing nip; a housing in which the fixing member is disposed, where the housing includes an entrance part, via which the recording medium enters therein, and a discharge part, via which the recording medium is discharged therefrom; and a blocking part disposed on the housing and toward an image surface of the recording medium to which the toner image is transferred, where the blocking part blocks nanodusts, which are generated while the toner image is being fixed to the recording medium, from being discharged to an outside of the housing.

19 Claims, 8 Drawing Sheets

FIXING UNIT AND IMAGE FORMING APPARATUS INCLUDING THE SAME

CROSS-REFERENCE TO RELATED APPLICATIONS

This application claims priority to Korean Patent Application No. 10-2013-0001791, filed on Jan. 7, 2013, and all the benefits accruing therefrom under 35 U.S.C. §119, the contents of which in their entireties are herein incorporated by reference.

BACKGROUND

1. Field

The disclosure relates to a fixing unit and an image forming apparatus including the fixing unit.

2. Description of the Related Art

An image forming apparatus typically forms an electrostatic latent image on a surface of a photosensitive media by irradiating light modulated based on image information, and forms a visible toner image on the surface of the photosensitive media by supplying toner on the electrostatic latent image. Such a visible image is typically transferred to a recording media and then fixed by using heat and pressure, thereby completing a printing process.

However, nanodusts having sizes of several tens to several hundreds nanometers may be generated as a by-product while forming an image by an image forming apparatus. Since such nanodusts may pass through cell membranes of human bodies, such nanodusts may easily penetrate human bodies via human respiratory systems or skin. It has been reported that nanodusts in human bodies may cause various kinds of diseases. Accordingly, recently, in Europe and the like, all types of environmental restriction items related to nanodust discharge amounts have been imposed.

SUMMARY

Provided is a fixing unit which reduces amounts of nanodusts discharged outside an image forming apparatus.

Provided is an image forming apparatus including the fixing unit.

Additional aspects will be set forth in part in the description which follows and, in part, will be apparent from the description, or may be learned by practice of the presented embodiments.

According to an embodiment of the invention, a fixing unit includes a fixing which defines a fixing nip through which a recording medium passes, where the fixing member fixes a toner image transferred onto the recording medium by applying heat and pressure to the toner image on the recording medium, a housing in which the fixing member is disposed, where the housing includes an entrance part, via which the recording medium enters, and a discharge part, via which the recording medium is discharged, and a first blocking part disposed on the housing toward an image surface of the recording medium, to which the toner image is transferred, where the first blocking part blocks nanodusts generated while the toner image is being fixed to the recording medium from being discharged outside the housing.

In an embodiment, the housing may include a first cover arranged on the image-side of the recording medium and a second cover arranged on another side of the recording medium opposite to the image-side thereof, and the first blocking part may be disposed on an upstream side of the first cover with respect to a transfer direction of the recording medium and may define a storage space for storing the nanodusts.

In an embodiment, the first blocking part may include a first plate disposed in a direction to cross the transfer direction of the recording medium, and a second plate which extends from the first plate toward the fixing nip.

In an embodiment, the second plate may be spaced apart from the fixing nip in such a way that the nanodusts are transferred to the storage space.

In an embodiment, a distance between the second plate and the fixing nip may be in a range from about 0.5 centimeter (cm) to about 1 cm.

In an embodiment, a distance between the first blocking part and the fixing member in the transfer direction of the recording medium may be greater than a distance between an upstream side of the second cover and the fixing member in the transfer direction of the recording medium.

In an embodiment, the first blocking part may include a dust collector which collects the nanodusts.

In an embodiment, the dust collector may include a porous filter in which a plurality of micro holes is defined.

In an embodiment, the micro holes may have a size in a range from about 0.2 micrometer (μm) to about 0.45 μm.

In an embodiment, the dust collector may include fire-retardant fiber.

In an embodiment, the dust collector may include a metal.

In an embodiment, the first blocking part may be detachable from the first cover.

In an embodiment, the first blocking part may block a portion of a fluid-boundary layer induced by the recording medium entering via the entrance.

In an embodiment, the first blocking part may be spaced apart from a transfer path of the recording medium to allow the recording medium to enter via the entrance part.

In an embodiment, a distance between the recording medium and the first blocking part may be in a range from about 0.5 cm to about 1 cm.

In an embodiment, the fixing unit may further include a second blocking part disposed adjacent to the discharge part of the housing, where the second blocking part blocks the nanodusts from passing through between the fixing member and the first cover and being discharged via the discharge part.

In an embodiment, the second blocking part may extend from the first cover toward the fixing member.

In an embodiment, a distance between the second blocking part and the fixing member may be about 5 millimeters (mm) or less.

According to another embodiment of the invention, an image forming apparatus includes a photosensitive medium, on which an electric latent image is formed, and a fixing unit which fixes a toner image transferred onto a recording medium by applying heat and pressure to the toner image, wherein the fixing unit includes: a fixing member which defines a fixing nip through which the recording medium passes, where the fixing member fixes the toner image transferred onto the recording medium by applying the heat and the pressure to the recording medium; a housing in which the fixing member is disposed, where the housing comprises an entrance part, via which the recording medium enters therein, and a discharge part, via which the recording medium is discharged therefrom; and a blocking part disposed on the housing and toward an image surface of the recording medium, to which the toner image is transferred, where the blocking part blocks nanodusts, which are generated while the toner image is being fixed to the recording medium, from being discharged to an outside of the housing.

BRIEF DESCRIPTION OF THE DRAWINGS

These and/or other features will become apparent and more readily appreciated from the following description of the embodiments, taken in conjunction with the accompanying drawings in which.

DETAILED DESCRIPTION

Figure 1:
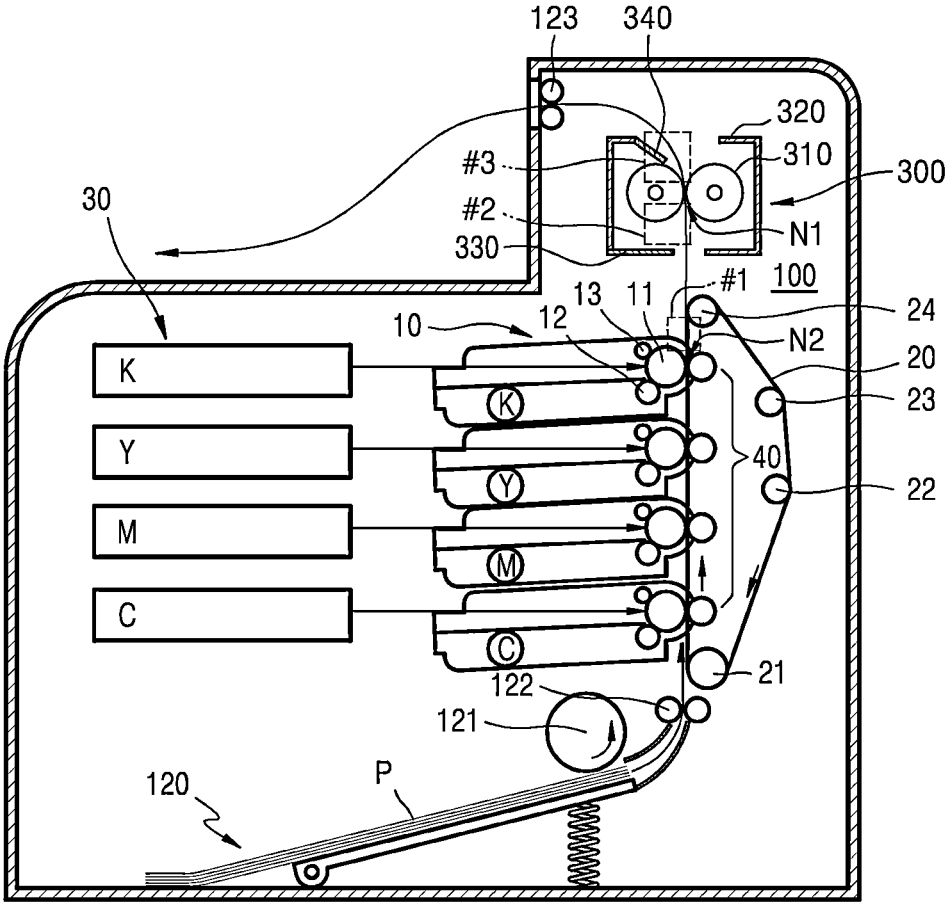
FIG. 1 is a cross-sectional view illustrating an embodiment of an image forming apparatus including a fixing unit according to the invention.

The invention will be described more fully hereinafter with reference to the accompanying drawings, in which embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

Hereinafter, embodiments of the invention will be described in further detail with reference to the accompanying drawings.

FIG. 1 is a cross-sectional view illustrating an embodiment of an image forming apparatus including a fixing unit 300 according to the invention. Referring to FIG. 1, a printing device 100 for printing an image on a recording medium via an electrophotographic process and the fixing unit 300 in the printing device 100 is illustrated. In an embodiment, as shown in FIG. 1, the image forming apparatus may be an electrophotographic image forming apparatus that prints a color image using a developer (hereinafter, referred to as toner).

The printing device 100 includes exposure units 30, developing units 10 and a transfer unit. In such an embodiment, to print the color image, the printing device 100 may include four developing units 10C, 10M, 10Y and 10K containing toner of four different colors, for example, cyan ("C"), magenta ("M"), yellow ("Y") and black ("K") and four exposure units 30C, 30M, 30Y and 30K corresponding to the four developing units 10C, 10M, 10Y and 10K, respectively.

The developing units 10C, 10M, 10Y and 10K each include a photosensitive drum 11 that is an image-bearing medium where an electrostatic latent image is formed and a developing roller 12 for developing the electrostatic latent image. An electrifying bias is applied to an electrifying roller 13 of each of the developing units 100, 10M, 10Y and 10K to electrify an outer circumference of the photosensitive drum 11 with substantially uniform electric potentials. In an alternative embodiment, a corona electric discharger (not shown) may be included instead of the electrifying roller 13. The developing roller 12 supplies toner attached to an outer circumference thereof to the photosensitive drum 11. A developing bias is applied to the developing roller 12 to supply the toner to the photosensitive drum 11. In an embodiment, a supplying roller that attaches toner contained therein to the developing roller 12, a restriction member (not shown) that controls, e.g., restricts, an amount of the toner attached to the developing roller 12, or an agitator (not shown) that transfers the toner contained therein to the supplying roller and/or the developing roller 12 may be further included in each of the developing units 10C, 10M, 10Y and 10K. In an embodiment, a cleaning blade (not shown) that removes toner attached to an outer circumference of the photosensitive drum 11 before electrification or a containing space for containing the removed toner may be included in the developing units 10C, 10M, 10Y and 10K.

In such an embodiment, as shown in FIG. 1, the transfer unit may include a recording medium return belt 20 and four transfer rollers 40. The recording medium return belt 20 faces the outer circumference of the photosensitive drum 11 exposed outside the developing units 100, 10M, 10Y and 10K. The recording medium return belt 20 is circularly driven while being supported by a plurality of support rollers 21, 22, 23 and 24. In an embodiment, as shown in FIG. 1, the recording medium return belt 20 is substantially vertically disposed in the printing device 100. The four transfer roller 40 are arranged to face the photosensitive drums 11 of the developing units 10C, 10M, 10Y and 10K, respectively, with the recording medium return belt 20 therebetween. A transfer bias is applied to the transfer roller 40. The transfer rollers 40 and the photosensitive drums 11 collectively define a transfer nip N2 therebetween. The exposure units 30C, 30M, 30Y, and 30K scan light corresponding to image information of C, M, Y and K colors, respectively, to the photosensitive drums 11 corresponding thereto. In an embodiment, as shown in FIG. 1, the exposure units 30C, 30M, 30Y and 30K include laser scanning units including laser diodes as a light source.

Hereinafter, a process of forming a color image by an embodiment of the printing device 100 will be described in detail.

In an embodiment, the photosensitive drums 11 of the developing units 10C, 10M, 10Y and 10K are electrified with substantially uniform electric potentials by the electrifying bias applied to the electrifying rollers 13. The four exposure units 30C, 30M, 30Y, and 30K form an electrostatic latent image by scanning the light corresponding to image information of C, M, Y and K colors to the photosensitive drums 11 corresponding thereto. The developing bias is applied to the developing rollers 12, and the toner that is attached to the outer circumferences of the developing rollers 12 is attached to the electrostatic latent image, thereby respectively forming toner images T (shown in FIG. 2A) having C, M, Y and K colors on the photosensitive drums 11 of the developing units 10C, 10M, 10Y and 10K.

A medium, on which the toner images T are formed, for example, a recording medium P, is withdrawn from a cassette 120 by a pickup roller 121. The recording medium P is moved to the recording medium return belt 20 by a transfer roller 122. In an embodiment, the recording medium P may be attached to a surface of the recording medium return belt 20 due to an electrostatic force and is transferred at the same speed as a moving speed of the recording medium return belt 20.

In one embodiment, for example, a front end of the recording medium P arrives simultaneously at the transfer nip N2 facing the transfer roller 40 and at a front end of the toner image T of C color formed on the outer circumference of the photosensitive drum 11 of the developing unit 100 facing the transfer roller 40. When the transfer bias is applied to the transfer roller 40, the toner image T formed on the photosensitive drum 11 is transferred to the recording medium P. As the recording medium P is transferred, toner images T of M, Y and K colors respectively formed on the photosensitive drums 11 of the developing units 10M, 10Y and 10K are sequentially transferred to overlap one another, thereby forming a color toner image T on the recording medium P.

The color toner image T transferred to the recording medium P is maintained on a surface of the recording medium P by the electrostatic force. The fixing unit 300 fixes the color toner image T onto the recording medium P using a fixing nip N1 by providing heat and pressure to the recording medium P. The recording medium P, after fixing is completed, is discharged outside the image forming apparatus by a discharge roller 123.

Figure 2A:
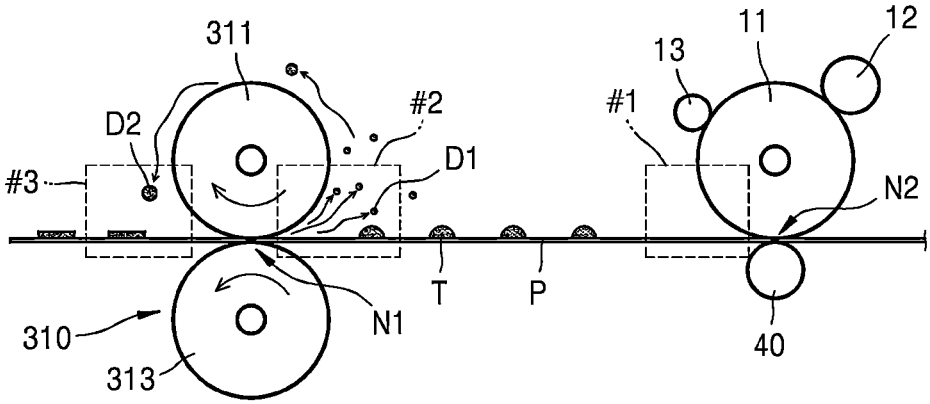
FIGS. 2A and 2B are diagrams illustrating nanodusts generated at respective positions and amount thereof while the image forming apparatus of FIG. 1 is forming an image.
Figure 2B:
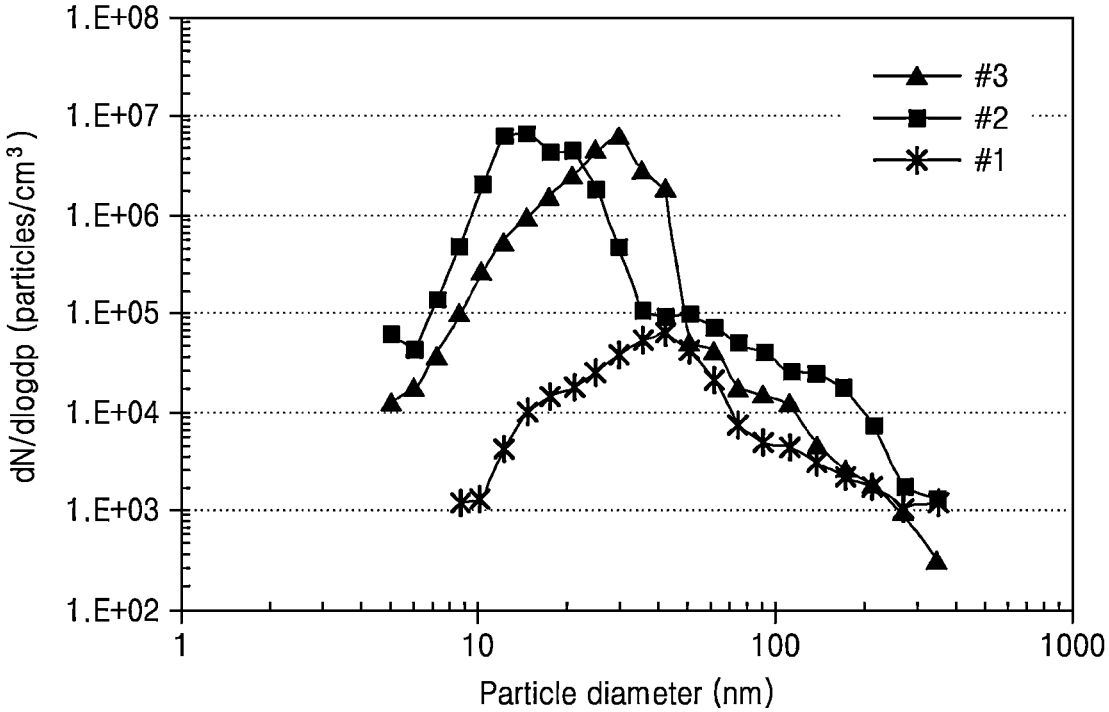

FIGS. 2A and 2B are diagrams illustrating nanodusts generated at respective positions and an amount thereof while the image forming apparatus of FIG. 1 is forming an image. FIG. 2A is a schematic view illustrating positions for measuring nanodusts in the image forming apparatus of FIG. 1, and FIG. 2B is a graph illustrating the amounts of the generated nanodusts measured at the measuring positions of FIG. 2A. Herein, nanodusts D1 and D2 mean particles having diameters in a range from about 10 nanometers (nm) to about 30 nanometers (nm), generated in an image forming process, and the nanodusts D1 and D2 include nano-particles, fine particles, and ultrafine particles.

Referring to FIG. 2A, when measuring the amount of generated nanodusts D1 and D2, the measuring positions are determined as a downstream (or lower) area #1 of the transfer nip N2, an upstream (or upper) area #2 of the fixing nip N1, and a downstream area #3 of the fixing nip N1. Referring to FIG. 2B, the measured amount of nanodusts D1 and D2 is greatest at the upstream area #2 of the fixing nip N1. The measured amount of nanodusts D1 and D2 at the downstream area #3 of the fixing nip N1 is less than the measured amount of nanodusts D1 and D2 at the upstream area #2 of the fixing nip N1. The measured amount is smallest at the downstream area #1 of the transfer nip N2. As shown in FIG. 2B, the nanodusts D1 having a size of about 10 nm are detected the most at the upstream area #2 of the fixing nip N1, and the nanodusts D2 having a size of about 30 nm are detected the most at the downstream area #3 of the fixing nip N1.

As shown in FIGS. 2A and 2B, the nanodusts D1 and D2 are generally generated around the fixing nip N1 during the image forming process and transferred toward the upstream area of the fixing nip N1. Also, the nanodusts D2 detected at the downstream area #3 of the fixing nip N1 are greater in size than the nanodusts D1 detected at the upstream area #2 of the fixing nip N1. Accordingly, a size of a part of the nanodusts D1 may become increased while detouring a fixing member 310.

Figure 3A:
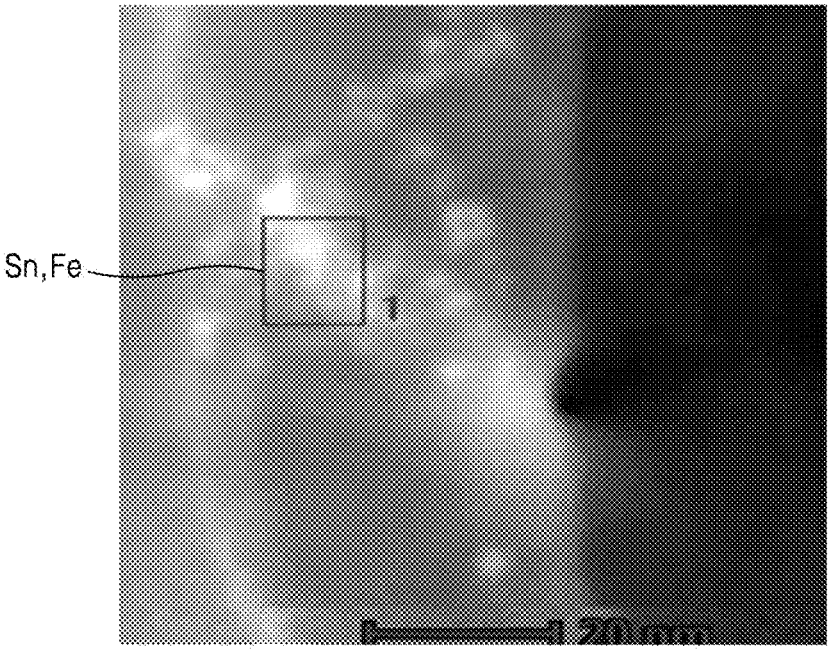
FIGS. 3A and 3B are diagrams illustrating results of analyzing components of nanodusts collected at an upstream area of a fixing nip.
Figure 3B:
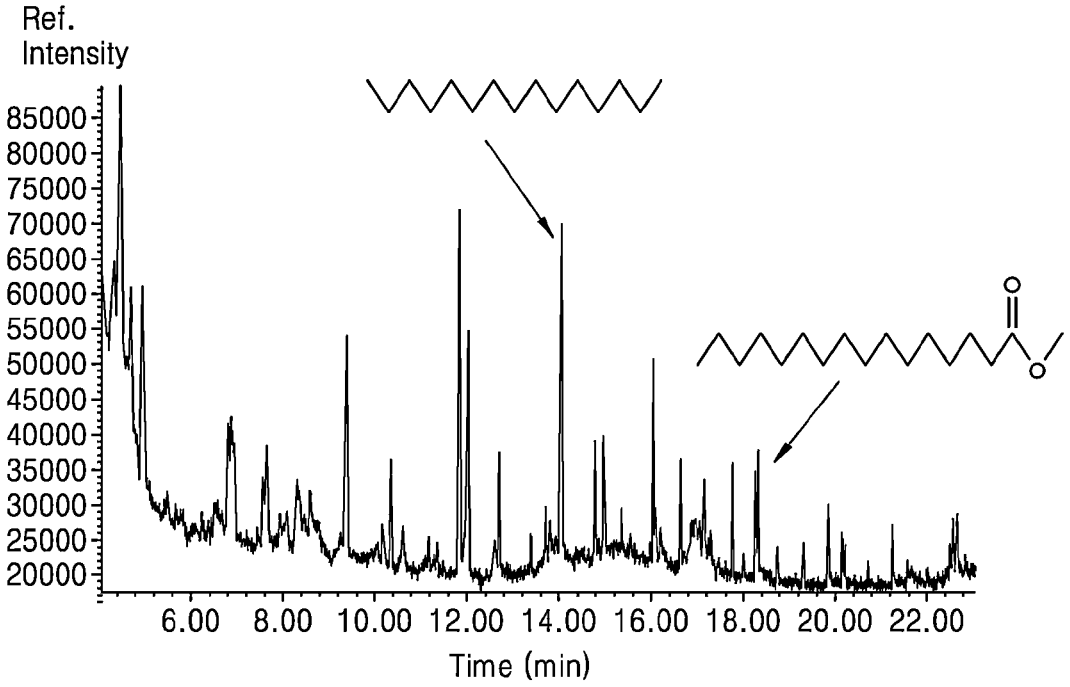

FIGS. 3A and 3B are diagrams illustrating results of analyzing components of the nanodusts collected at the upstream area of the fixing nip N1 of FIG. 2A.

FIG. 3A is a transmission electron microscope ("TEM") image illustrating the nanodusts D1 collected at the upstream area #2 of the fixing nip N1 of FIG. 2A during an experiment. As shown in FIG. 3A, the nanodusts D1 partially included metallic components Sn and Fe. The metallic components are the same components as the inner additives of the toner used in the experiment. As shown by the metallic components, the nanodusts D1 may be generated from materials in the toner, which is decomposed or volatilized due to heat while passing through the fixing nip N1.

FIG. 3B is a view illustrating a result of analyzing the nanodusts D1 collected at the upstream area #2 of the fixing nip N1 of FIG. 2A during an experiment using a gas chromatography-mass spectrometry ("GC-MS"). Referring to FIG. 3B, the result of analyzing the components of the nanodusts D1 shows that the nanodusts D1 collected at the upstream area #2 of the fixing nip N1 include components having the following Structural Formulas 1 and 2.

Structural Formula (1)

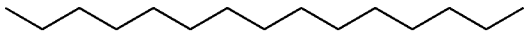

Structural Formula (2)

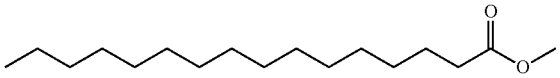

Considering a component having the following Structural Formula (3) as used as wax material of the toner in the experiment, the parts of the nanodusts D1 may be a particle generated when wax of the toner is ionized and thermally decomposed.

Structural Formula (3)

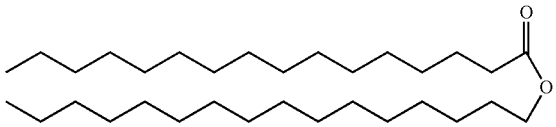

As in FIGS. 3A and 3B showing the results of analyzing the occurrence positions and the components of the nanodusts D1 and D2, the nanodusts D1 and D2 may be generally generated around the fixing nip N1, and more particularly, the nanodusts D1 at the upstream area of the fixing nip N1 may be generated when the toner is decomposed or volatilized while heating, pressurizing, and fixing the toner image T at the fixing nip N1.

Figure 4:
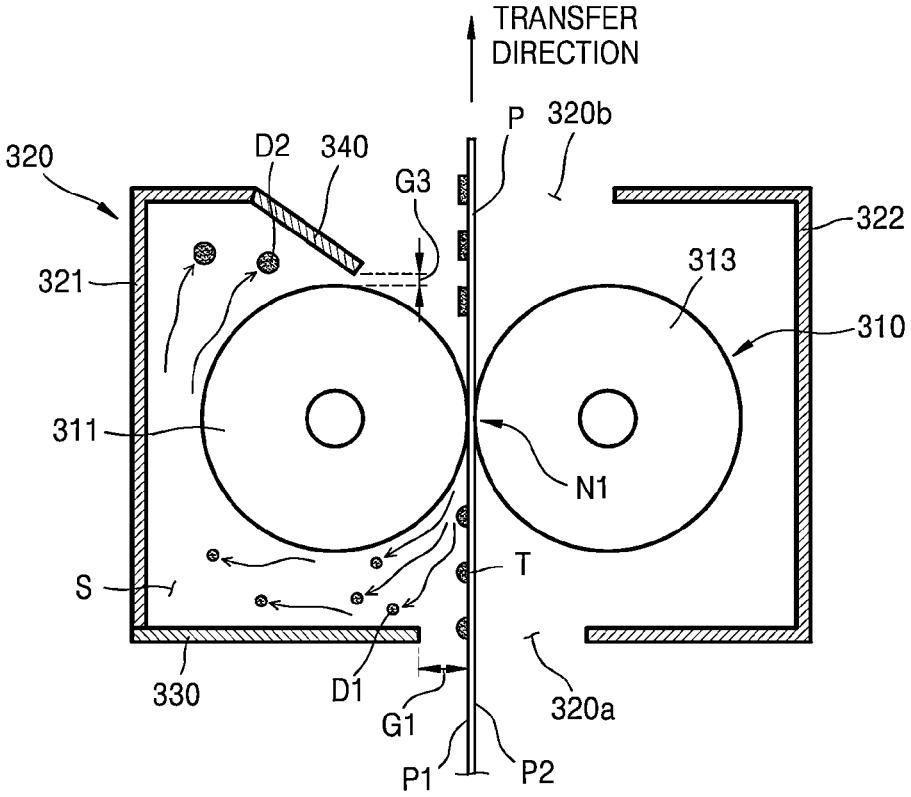
FIG. 4 is a cross-sectional view illustrating an embodiment of the fixing unit of the image forming apparatus of FIG. 1.

In an embodiment, as shown in FIG. 4, the fixing unit 300 includes a blocking part 330 such that the nanodusts D1 and D2 generated at the fixing nip N1 may be effectively prevented from being discharged outward.

FIG. 4 is a cross-sectional view illustrating an embodiment of the fixing unit 300 of the image forming apparatus of FIG. 1. FIG. 4 shows an embodiment of the fixing unit 300, which is a roller type including a heater 311 having a roller shape.

Referring to FIG. 4, an embodiment of the fixing unit 300 may include a fixing member 310, a housing 320 surrounding at least a portion of the fixing member 310, and the blocking part 330 disposed in the housing 320.

The fixing member 310 forms the fixing nip N1 and applies heat and pressure to the recording medium P passing through the fixing nip N1 according to the transfer path. Via the fixing member 310, the toner image T transferred to the recording medium P is fixed. The fixing member 310 may include the heater 311 and a pressurizer 313. The heater 311 and the pressurizer 313 are disposed to face each other and form the fixing nip N1. In one embodiment, for example, the pressurizer 313 may be a roller including a metallic support body and an elastic layer disposed on the metallic support body. The heater 311 and the pressurizer 313 are biased in directions by a bias element (not shown), for example, a spring, to be engaged with each other. The elastic layer of the pressurizer 313 is partially deformed, thereby forming the fixing nip N1 where heat from the heater 311 is transferred to the toner image T on the recording medium P.

The heater 311 and the pressurizer 313 are disposed in a space defined in the housing 320, and the housing 320 includes an entrance part 320*a*, via which the recording medium P enters inward, and a discharge part 320*b*, via which the recording medium P is discharged. The housing 320 includes a first cover 321 disposed on a side of an image surface P1 of the recording medium P and a second cover 322 disposed on a side of an opposite surface P2 of the image surface P1. The first cover 321 covers the heater 311, and the second cover 322 covers the pressurizer 313.

In an embodiment, the blocking part 330 is disposed, e.g., installed, in the housing 320 to face the image surface P1 of the recording medium, onto which the toner image T is transferred. In one embodiment, for example, the blocking part 330 may be disposed substantially perpendicular to the image surface P1 of the recording medium. While the toner image T is fixed to the recording medium P, e.g., while the recording medium P enters the fixing nip N1, a part of the toner image T may be decomposed by the heat and pressure of the fixing nip N1, thereby generating the nanodusts D1 and D2. The blocking part 330 effectively prevents the nanodusts D1 and D2 from being discharged from the housing 320.

In an embodiment, as shown in FIG. 4, the nanodusts D1 and D2 generated around the fixing nip N1 may be transferred toward an upstream (or upper) side of the transfer direction of the recording medium P based on the fixing nip N1. In such an embodiment, transfer of the nanodusts D1 and D2 toward a downstream (or lower) area of the transfer direction is effectively prevented from being discharged from the housing 320 by the fixing member 310. The nanodusts D1 and D2 are transferred toward the first cover 321 of the housing 320 among the upstream side of the transfer direction. Transfer of the nanodusts D1 and D2 toward the second cover 322 is effectively prevented by the recording medium P entering the fixing nip N1. Accordingly, a distance between the recording medium P and the second cover 322, which has substantially no effect on discharging the nanodusts D1 and D2, is not limited to a specific distance. In an embodiment, the blocking part 330 may be installed on the upstream side of the transfer path based on the fixing nip N1 in the first cover 321, such that the discharging of the nanodusts D1 and D2 transferred toward the first cover 321 of the housing 320 may be effectively prevented.

The blocking part 330 is disposed adjacent to the first cover 321, e.g., at a lower portion of the first cover 321, and defines a storage space S for storing or accumulating the nanodusts D1 and D2. The nanodusts D1 and D2 are stored in the storage space S, and the nanodusts D1 and D2 stored in the storage space may be coupled with other adjacent nanodusts D1 and D2. Via coupling, the size of the nanodusts D1 and D2 may be gradually increased to a predetermined size, e.g., a size greater than 300 nm, which is considered to be less harmful to a human body.

FIGS. 5 to 7A are cross-sectional views illustrating alternative embodiments of the fixing unit of the image forming apparatus of FIG. 1. The fixing units in FIGS. 5 to 7A are substantially the same as the fixing unit 300 shown in FIG. 4 except for the blocking part 330. The same or like elements shown in FIGS. 5 to 7A have been labeled with the same reference characters as used above to describe the embodiment of the fixing unit 300 shown in FIG. 4, and any repetitive detailed description thereof may hereinafter be omitted or simplified.

Figure 5:
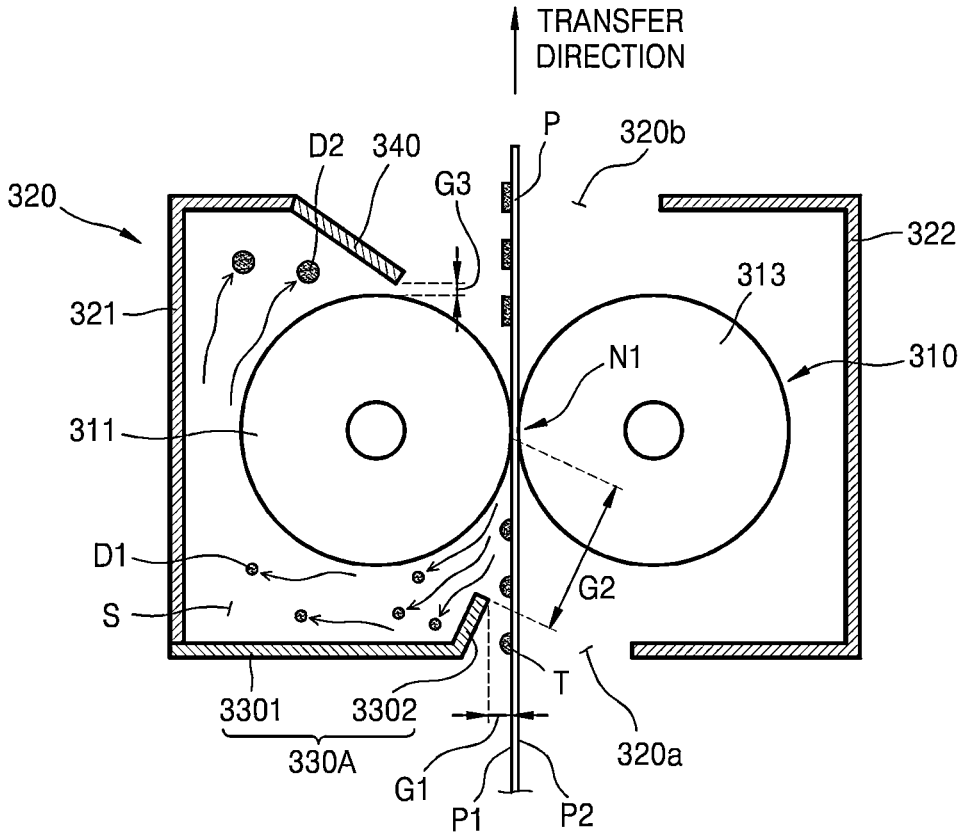
FIG. 5 is a cross-sectional view illustrating an alternative embodiment of the fixing unit of the image forming apparatus of FIG. 1.

Referring to FIG. 5, an alternative embodiment of the fixing unit includes a blocking part 330A including a first plate 3301 extend in a direction crossing the transfer direction of the recording medium P and a second plate 3302 extending toward the fixing nip N1 from an end of the first plate 3301.

In such an embodiment, the second plate 3302 guides the nanodusts D1 and D2 generated around the fixing nip N1 to be transferred to the storage space S, and effectively prevents the nanodusts D1 and D2 stored in the storage space S from being transferred to the entrance part 320*a*.

In such an embodiment, the second plate 3302 may be spaced from the fixing nip N1 to allow the nanodusts D1 and D2 generated around the fixing nip N1 to be transferred to the storage space S. A distance G2 between an end of the second plate 3302 and the fixing nip N1 may be in a range from about 0.5 centimeter (cm) to about 1 centimeter (cm). When the distance G2 is less than about 0.5 cm, the nanodusts D1 and D2 generated around the fixing nip N1 may not effectively pass through between the second plate 3302 and the fixing nip N1, and the second plate 3302 may block a portion of the nanodusts D1 and D2 from being transferred to the storage space S. As a result, an amount of the nanodusts D1 and D2 discharged outward may be increased. When the distance G2 is more than 1 cm, the nanodusts D1 and D2 stored in the storage space S may pass through a space between the second plate 3302 and the fixing nip N1, thereby discharging the nanodusts outward via the entrance part 320*a*.

Figure 6:
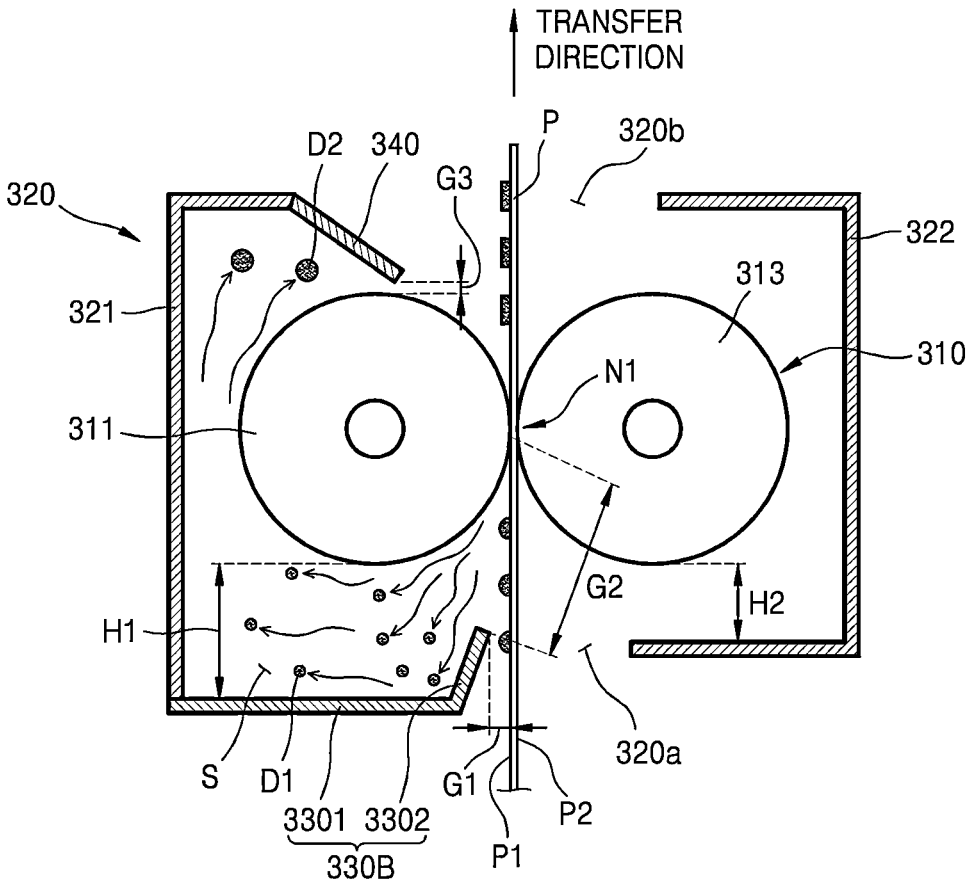
FIG. 6 is I a cross-sectional view illustrating another alternative embodiment of the fixing unit of the image forming apparatus of FIG. 1.

Referring to FIG. 6, another alternative embodiment of the fixing unit includes a blocking part 330B including a first plate 3301 extend in a direction crossing the transfer direction of the recording medium P and a second plate 3302 extending toward the fixing nip N1 from an end of the first plate 3301. In such an embodiment, a distance H1 between the first plate 3301 and the fixing member 310 is greater than a distance H2 between a portion of the second cover 322 corresponding to the first plate 3301 (e.g., a lower portion) and the fixing member 310. In such an embodiment, the storage space S to store the nanodusts D1 and D2 is provided on a side of the first cover 321, and a size of the second cover 322 may be reduced. In such an embodiment, the distance H1 between the first plate 3301 and the fixing member 320, and the distance H2 between the lower portion of the second cover 322 and the fixing member 320 mean distances therebetween in the transfer direction of the recording medium P.

Figure 7A:
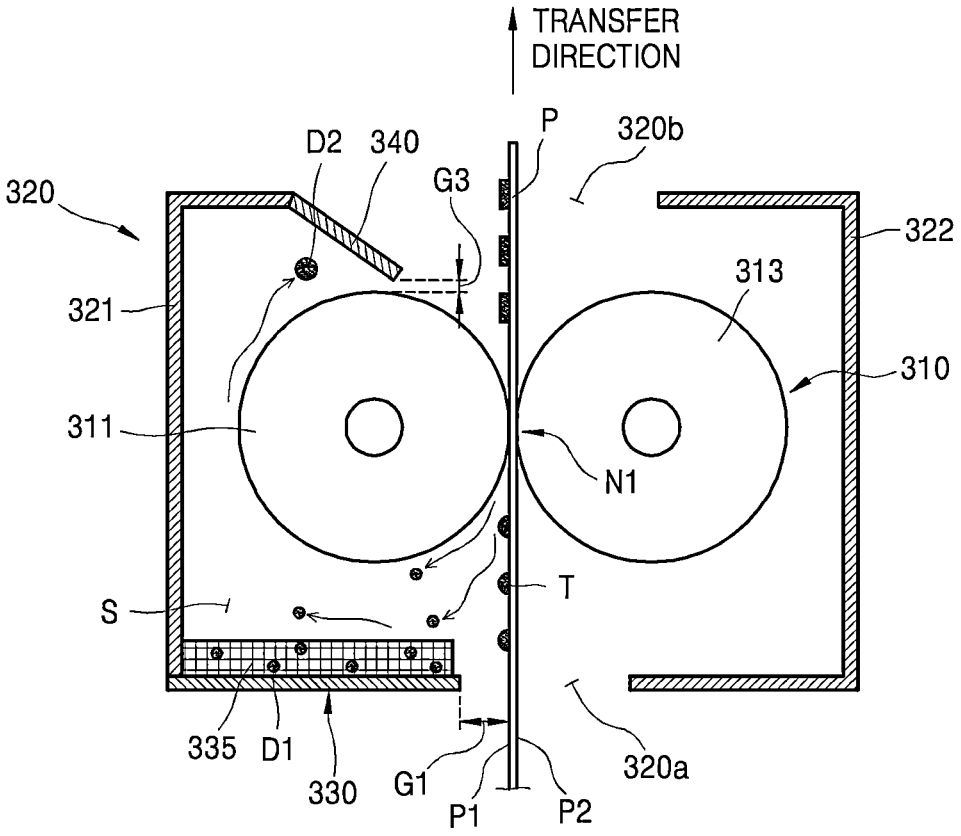
FIG. 7A is a cross-sectional view illustrating another alternative embodiment of the fixing unit of the image forming apparatus of FIG. 1.
Figure 7B:
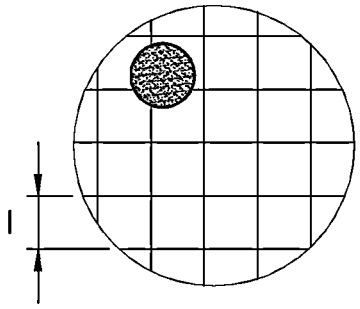
FIG. 7B is an enlarged view of a portion of a dust collector of the fixing unit shown in FIG. 7A.

Referring to FIGS. 7A and 7B, another alternative embodiment of the fixing unit includes a dust collector 335 for collecting the nanodusts D1 and D2. In such an embodiment, as shown in FIGS. 7A and 7B, the dust collector 335 may be disposed on the blocking part 330, but it is not limited thereto. In another alternative embodiment, the dust collector 335 may be defined as a portion of the blocking part 330. In one embodiment, for example, the blocking part 330 and the dust collector 335 may be integrally formed as a single unitary and indivisible unit, in such a way that the blocking part 330 may function as the dust collector 335.

In an embodiment, as shown in FIGS. 7A and 7B, the dust collector 335 may collect the nanodusts D1 and D2 stored in the storage space S. In such an embodiment, when a flow of fluid occurs inside the housing due to the transfer of the recording medium P, the nanodusts D1 and D2 may be effectively prevented from scattering and floating inside the housing 320 by the dust collector 335. In such an embodiment, the nanodusts D1 and D2 are effectively prevented from floating, thereby effectively preventing deterioration of fixing qualities that occur due to the nanodusts D1 and D2. In such an embodiment, when an amount of the nanodusts D1 and D2 increases during repetitive fixing processes, the dust collector 335 may effectively prevent the deterioration of image qualities that occur due to the nanodusts D1 and D2.

In one embodiment, for example, the dust collector 335 may be a porous filter, in which a plurality of micro holes are defined, to collect the nanodusts D1 and D2. A size I of the micro holes may be in a range from about 0.2 micrometer (μm) to about 0.45 micrometer (μm). When the size I of the micro holes is less than about 0.2 μm, a flow of the fluid occurring inside the housing may not efficiently pass through the micro holes such that the inside of the housing 320 may overheat. When the size I of the micro holes is larger than about 0.45 μm, the nanodusts D1 and D2 may not be effectively collected by the dust collector 335, such that the image qualities may be deteriorated by the nanodusts D1 and D2 passing through the dust collector 335. In one embodiment, the micro holes may have a shape of tetragons as shown in FIG. 7B, but are not limited thereto. In an alternative embodiment, the micro holes may have a shape of polygons or circles. In such an embodiment, the size I of the micro holes means a maximum diameter when the micro holes have a circular shape, and the size I of the micro holes means a maximum distance between sides when the micro holes have a polygonal shape.

In an embodiment, the toner image T may be fixed at a fixing temperature, e.g., in a range from about 140° C. to 170° C. while passing through the fixing nip N1. To apply heat to the toner image T, the heater 311 applies heat to the recording medium P at a temperature at least higher than a fixing temperature of the toner image T. In an embodiment, the dust collector 335 is disposed, e.g., installed or formed, inside the blocking part 330 and disposed adjacent to the heater 311. Accordingly, in such an embodiment, the dust collector 335 may include fire-retardant fiber such that the dust collector 335 may be effectively prevented from being damaged by heat discharged from the heater 311. In such an embodiment, where the dust collector 335 includes fire-retardant fiber, the dust collector 335 disposed adjacently to the heater 311 of a high temperature may be effectively prevented from being damaged by heat. In such an embodiment, the fire-retardant fiber may include polytetrafluoroethylene, for example.

In an embodiment, the dust collector 335 may include a metal. In such an embodiment, where the dust collector 335 includes the metal, about 40% of electromagnetic materials of the nanodusts D1 and D2 may be adsorbed to the dust collector 335. In such an embodiment, a bias voltage may be applied to the dust collector 335 including the metal to further increase an adsorption rate. In one embodiment, the dust collector 335 may include aluminum (Al) foil, for example.

In an embodiment, the blocking part 330 may be detachable from the first cover 321. In such an embodiment, where the blocking part 330 is detachable from the first cover 321, the nanodusts D1 and D2 stored inside may be removed by separating the blocking part 330 from the first cover 321, such that the nanodusts D1 and D2 stored inside the blocking part 330 may be efficiently removed. In such an embodiment, the nanodusts D1 and D2 stored in the blocking part 330 have the size greater than the initial nanodusts D1 and D2 generated around the fixing nip N1, such that any harm to human bodies while removing the nanodusts D1 and D2 may be reduced. In such an embodiment, as described above, the size of the nanodusts D1 and D2 increases when the nanodusts D1 and D2 stored in the blocking part 330 are coupled with adjacent nanodusts D1 and D2, and the size thereof increases as time passes.

Referring back to FIG. 4, the blocking part 330 may be disposed spaced apart from the recording medium P. A distance G1 between the blocking part 330 and the recording medium P may be predetermined such that an amount of the nanodusts D1 and D2 that are discharged to the outside is limited to be about 40,000 particles per cubic centimeter ($/cm^3$) or less.

Figure 8:
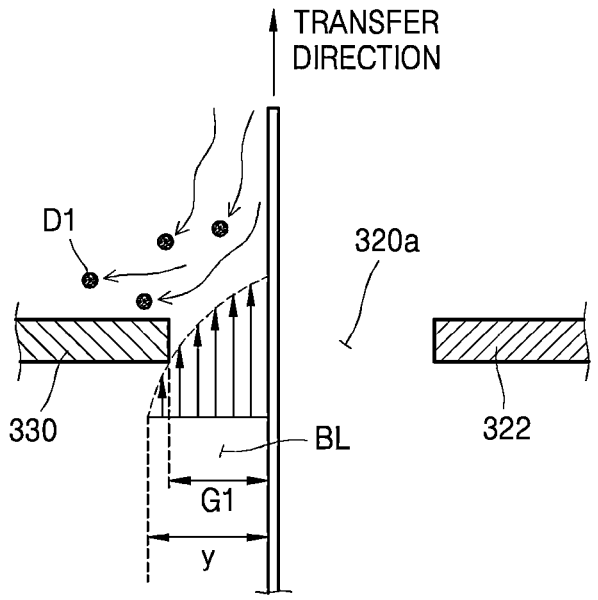
FIG. 8 is a schematic view illustrating a state of a fluid around an image surface of a recording medium entering via an entrance part of the fixing unit of FIG. 4.

In an embodiment, the blocking part 330 may block a portion of a fluid boundary layer BL induced by recording medium P entering via the entrance part 320*a*. FIG. 8 is a schematic view illustrating a state of a fluid around the image surface P1 of the recording medium P entering the entrance part 320*a* of the fixing unit 300 of FIG. 4. Referring to FIG. 8, a portion of the fluid located around the recording medium P is transferred in substantially the same direction as the transfer direction of the recording medium P due to the transfer of the recording medium P. A speed of the transfer of the fluid becomes higher when being closer to the recording medium P and becomes downstream when being farther from the recording medium P. The speed reduces to about zero (0) at a certain distance from the recording medium P. The fluid boundary layer BL is a layer of the fluid induced by the transfer of the recording medium P as described above, and means a layer at a point where the transfer speed of the fluid becomes about zero (0). A height y of the fluid boundary layer BL means a distance from the recording medium P at a point, where the transfer speed of the fluid induced by the transfer of the recording medium P becomes about zero (0). In an embodiment, the blocking part 330 may block the part of the fluid boundary layer BL. In such an embodiment, when the blocking part 330 blocks the part of the fluid boundary layer BL, when the recording medium P is transferred to the entrance part 320*a*, only the fluid transferred in substantially the same direction as the transfer direction of the recording medium P is generated at the entrance part 320*a*, such that the nanodusts D1 to be transferred in a direction opposite to the transfer direction is effectively prevented from passing through the entrance part 320*a*, and thereby transferred to the storage space S in the blocking part 330. When the distance G1 between the blocking part 330 and the recording medium P is greater than the height y of the fluid boundary layer BL, the nanodusts D1 may be transferred between the blocking part 330 and the fluid boundary layer, such that the amount of the discharged nanodusts D1 may increase. In an embodiment, the distance G1 between the blocking part 330 and the recording medium P is set to be smaller than the height y of the fluid boundary layer BL in such a way that the blocking part 330 may block the part of the fluid boundary layer BL, and the discharge of the nanodusts D1 to be transferred in the direction opposite to the transfer direction of the recording medium P may be blocked or effectively prevented. In one embodiment, for example, the distance G1 for blocking the part of the fluid boundary layer BL or the distance G1 between the blocking part 330 and the recording medium P may be about 1 centimeter (cm) or less.

In an embodiment, the distance G1 between the blocking part 330 and the recording medium P may be about 0.5 cm or more. When the distance G1 is less than about 0.5 cm, while the recording medium P is passing through the entrance part 320*a*, paper jams may occur when the recording medium P is caught by the blocking part 330, or the toner image T transferred to the recording medium P may be scratched by the blocking part 330, thereby deteriorating image qualities.

Referring to FIG. 4, the fixing unit 300 may further include a second blocking part 340. The second blocking part 340 may block or effectively prevent the nanodusts D1 and D2 generated around the fixing nip N1 from passing through the heater 311 and the first cover 321 and from being discharged outward. As described with reference to FIGS. 2A and 2B, the nanodusts D1 and D2 may detour the heater 311. Accordingly, in an embodiment, the second blocking part 340 may extend obliquely toward the heater 311. In one embodiment, for example, the second blocking part 340 may be disposed on the downstream side of the transfer direction of the recording medium P with the fixing nip N1 as the center in the first cover 321. The second blocking part 340 may be extended from the first cover 321 to the heater 311. The second blocking part 340 may be separated so as not to have an effect on a rotation of the heater 311. A distance G3 between the second blocking part 340 and the heater 311 may be about 5 mm or less. Via this configuration, it is possible to block or effectively prevent the nanodusts D2 having an increased size from being discharged.

Hereinafter, the invention will be described in detail by comparing Embodiment according to the invention and a Comparative Example prepared for an experiment, but is not limited thereto.

EMBODIMENT FOR EXPERIMENT

As one embodiment of the invention, an embodiment in which an image forming apparatus including the fixing unit 300 is used in which the blocking part 330 is installed on the upstream side of the transfer direction of the recording medium P with the fixing nip N1 as the center, as shown in FIG. 4, was prepared for an experiment. In the embodiment, the distance G1 between the blocking part 330 and the recording medium P was about 5 mm, and Al foil was used as a material for the blocking part 330.

Comparative Example for Experiment

As the comparative example for the experiment, an image forming apparatus, in which the fixing unit 300 shown FIG. 4 is included but the blocking part 330 is excluded, was prepared.

Conditions for Experiment

In the experiment, the image forming apparatus of Embodiment according to the invention and the image forming apparatus of Comparative Example were disposed inside a chamber (not shown), and discharge amounts of the nanodusts D1 and D2 that were generated while performing an image forming process for about 20 minutes were sequentially measured. To measure the discharge amounts of the nanodusts D1 and D2, a condensation particle counter ("CPC") was used.

Figure 9:
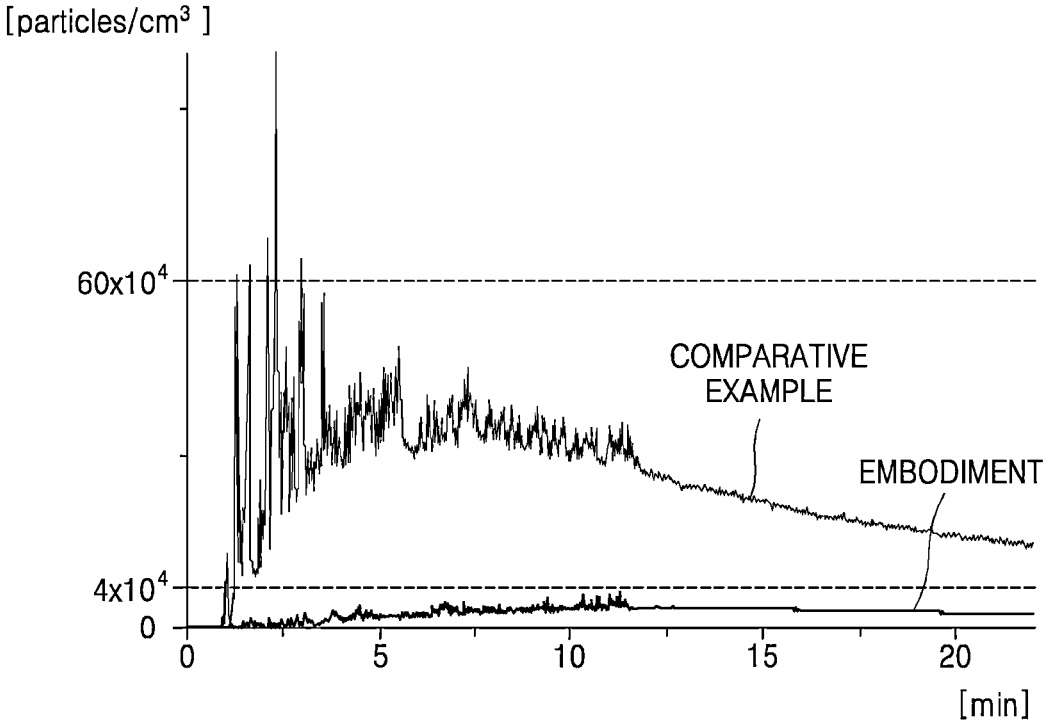
FIG. 9 is a graph illustrating a result of measuring amounts of generated nanodusts of Embodiment of the invention and Comparative example.

FIG. 9 is a graph illustrating a result of measuring the amounts of the generated nanodusts D1 and D2 by the image forming apparatuses of Embodiment and Comparative Example. Referring to FIG. 9, in the image forming apparatus of Comparative Example, the amount of the nanodusts D1 and D2 that was discharged outward was measured as being over about $4\times10^4/cm^3$ for most of the time of the measurement, and was measured as being over about $60\times10^4/cm^3$ during an early stage of an operation of the image forming apparatus. As shown in FIG. 9, in the image forming apparatus of Embodiment according to the invention, the amount of the nanodusts D1 and D2 discharged outward was shown as being about $4\times10^4/cm^3$ or less regardless of elapsed time.

As shown in FIG. 9, when the blocking part 330 is installed on the upstream side of the transfer direction of the recording medium P with the fixing nip N1 as the center as in Embodiment according to the invention, the amount of the nanodusts D1 and D2 is substantially reduced.

Some embodiments of the invention have been described with reference to the drawings for convenience of description and illustration, but the invention is not limited thereto. For example, in the described embodiment, the image forming apparatus forming a color image using the toner of C, M, Y and K colors has been described, but is not limited thereto.

As described above, according to the one or more of the above embodiments of the invention, the image forming apparatus may be any image forming apparatus for forming images on the recording media P using various methods such as image forming apparatuses using toner of a single color.

It should be understood that the embodiments described therein should be considered in a descriptive sense only and not for purposes of limitation. Descriptions of features or aspects within each embodiment should typically be considered as available for other similar features or aspects in other embodiments.

What is claimed is:

1. A fixing unit comprising:

a fixing member which defines a fixing nip, through which a recording medium passes, wherein the fixing member fixes a toner image transferred onto the recording medium by applying heat and pressure to the toner image on the recording medium;

a housing in which the fixing member is disposed, wherein the housing comprises an entrance part, via which the recording medium enters therein, and a discharge part, via which the recording medium is discharged therefrom; and a first blocking part disposed on the housing and toward an image surface of the recording medium to which the toner image is transferred, wherein the first blocking part blocks nanodusts, which are generated while the toner image is being fixed to the recording medium, from being discharged to an outside of the housing, wherein a distance between an end of the first blocking part and the fixing nip is in range from about 0.5 centimeter to about 1 centimeter.

2. The fixing unit of claim 1, wherein the housing comprises a first cover arranged on an image-side of the recording medium, and a second cover arranged on another side of the recording medium opposite to the image-side thereof, and the first blocking part is disposed on an upstream side of the first cover with respect to a transfer direction of the recording medium, and defines a storage space for storing the nanodusts.

3. The fixing unit of claim 2, wherein the first blocking part comprises:

a first plate disposed in a direction to cross the transfer direction of the recording medium; and a second plate which extends from the first plate toward the fixing nip.

4. The fixing unit of claim 3, wherein the second plate is spaced apart from the fixing nip in such a way that the nanodusts are transferred to the storage space.

5. The fixing unit of claim 4, wherein a distance between the second plate and the fixing nip is in range from about 0.5 centimeter to about 1 centimeter.

6. The fixing unit of claim 2, wherein a distance between the first blocking part and the fixing member in the transfer direction of the recording medium is greater than a distance between an upstream side of the second cover and the fixing member in the transfer direction of the recording medium.

7. The fixing unit of claim 2, wherein the first blocking part comprises a dust collector which collects the nanodusts.

8. The fixing unit of claim 7, wherein the dust collector comprises a porous filter, in which a plurality of micro holes are defined.

9. The fixing unit of claim 8, wherein the micro holes have a size in a range from about 0.2 micrometer to about 0.45 micrometer.

10. The fixing unit of claim 8, wherein the dust collector comprises fire-retardant fiber.

11. The fixing unit of claim 7, wherein the dust collector comprises a metal.

12. The fixing unit of claim 2, wherein the first blocking part is detachable from the first cover.

13. The fixing unit of claim 1, wherein the first blocking part blocks a portion of a fluid-boundary layer induced by the recording medium entering via the entrance part.

14. The fixing unit of claim 1, wherein the first blocking part is spaced apart from a transfer path of the recording medium to allow the recording medium to enter via the entrance part.

15. The fixing unit of claim 1, wherein a distance between the recording medium and the first blocking part is in a range from about 0.5 centimeter to about 1 centimeter.

16. The fixing unit of claim 2, further comprising:

a second blocking part disposed adjacent to the discharge part of the housing, wherein the second blocking part blocks the nanodusts from passing through between the fixing member and the first cover and being discharged via the discharge part.

17. The fixing unit of claim 16, wherein the second blocking part extends from the first cover toward the fixing member.

18. The fixing unit of claim 16, wherein a distance between the second blocking part and the fixing member is about 5 millimeters or less.

19. An image forming apparatus comprising:

a photosensitive medium, on which an electric latent image is formed;

a fixing unit which fixes a toner image transferred onto a recording medium by applying heat and pressure to the toner image, wherein the fixing unit comprises:

a fixing member which defines a fixing nip through which the recording medium passes, wherein the fixing member fixes the toner image transferred onto the recording medium by applying the heat and the pressure to the recording medium;

a housing in which the fixing member is disposed, wherein the housing comprises an entrance part, via which the recording medium enters therein, and a discharge part, via which the recording medium is discharged therefrom; and a blocking part disposed on the housing and toward an image surface of the recording medium, to which the toner image is transferred, wherein the blocking part blocks nanodusts, which are generated while the toner image is being fixed to the recording medium, from being discharged to an outside of the housing, wherein a distance between an end of the blocking part and the fixing nip is in range from about 0.5 centimeter to about 1 centimeter.

* * * * *